United States Patent [19]

Kremer et al.

[11] Patent Number: 4,685,820

[45] Date of Patent: Aug. 11, 1987

[54] APPLICATOR DEVICE

[75] Inventors: Leon V. Kremer, Crystal Lake; Ronald E. Kieras, Algonquin, both of Ill.

[73] Assignee: Pittway Corporation, Cary, Ill.

[21] Appl. No.: 741,536

[22] Filed: Jun. 5, 1985

[51] Int. Cl.[4] ..... B43K 8/00; B43K 1/06

[52] U.S. Cl. ..... 401/260; 401/186; 401/206; 401/259; 401/264

[58] Field of Search ..... 401/258, 259, 260, 186, 401/264, 206

[56] References Cited

U.S. PATENT DOCUMENTS

| | | | |
|---|---|---|---|
| 1,033,520 | 7/1912 | Bator | 401/260 |
| 1,340,028 | 5/1920 | Erwin | 401/264 |
| 2,210,662 | 8/1940 | Garvey | 120/45 |
| 2,392,840 | 1/1946 | DeGroft | 15/134 |
| 2,424,323 | 7/1947 | Millholland | 91/50 |
| 2,623,227 | 12/1952 | Moonert | 15/139 |
| 2,624,902 | 1/1953 | Soldner | 15/139 |
| 2,637,466 | 5/1953 | Wright | 222/80 |
| 2,896,238 | 7/1959 | Riel | 15/137 |
| 3,003,183 | 10/1961 | Rosenthal | 15/566 |
| 3,003,184 | 10/1961 | Rosenthal | 15/581 |
| 3,032,802 | 5/1962 | Kusama | 15/563 |
| 3,108,314 | 10/1963 | House | 15/566 |
| 3,113,336 | 12/1963 | Langnickel | 15/563 |
| 3,127,630 | 4/1964 | LaMura | 15/537 |
| 3,133,307 | 5/1964 | Steinberg | 15/563 |
| 3,145,412 | 8/1964 | Levy | 15/569 |
| 3,159,863 | 12/1964 | LaMura | 15/537 |
| 3,229,866 | 1/1966 | Arbitman et al. | 401/186 X |
| 3,233,275 | 2/1966 | Hansen et al. | 15/563 |
| 3,281,887 | 11/1966 | Raffe | 15/569 |
| 3,296,649 | 1/1967 | Schwartzman | 15/566 |
| 3,340,560 | 9/1967 | Nakata | 15/563 |
| 3,377,124 | 4/1968 | Matsumoto | 401/260 X |
| 3,463,597 | 8/1969 | Wakai | 401/206 |
| 3,468,611 | 9/1969 | Ward | 401/186 |
| 3,589,824 | 6/1971 | Andrews | 401/206 |
| 3,640,631 | 2/1972 | Sotir | 401/206 |
| 3,682,559 | 8/1972 | Hirota | 401/278 |
| 3,738,760 | 6/1973 | Madeira | 401/4 |
| 3,922,100 | 11/1975 | Saito | 401/199 |
| 4,043,681 | 8/1977 | Funahashi | 401/151 |
| 4,157,874 | 6/1979 | Durand | 401/4 |
| 4,198,172 | 4/1980 | Meislik | 401/214 |
| 4,224,000 | 9/1980 | Endres | 401/198 |
| 4,281,779 | 8/1981 | Shepard | 222/501 |
| 4,380,403 | 4/1983 | Endres et al. | 401/213 |
| 4,408,921 | 10/1983 | Nagai | 401/198 |
| 4,511,273 | 4/1985 | Trotta | 401/260 |
| 4,543,005 | 9/1985 | Kuboshima | 401/260 |

FOREIGN PATENT DOCUMENTS

| | | | |
|---|---|---|---|
| 538909 | 6/1955 | Belgium | 401/260 |
| 539626 | 7/1955 | Belgium | 401/264 |
| 24908 | 3/1883 | Fed. Rep. of Germany | 401/260 |
| 802054 | 2/1951 | Fed. Rep. of Germany | 401/260 |
| 245751 | 3/1926 | Italy | 401/264 |
| 149734 | 12/1931 | Switzerland | 401/260 |
| 1708 | of 1889 | United Kingdom | 401/260 |

*Primary Examiner*—Steven A. Bratlie

*Attorney, Agent, or Firm*—Frijouf, Rust & Pyle

[57] ABSTRACT

An improved applicator device is disclosed for applying an applicator material such as a liquid or a flowable solid to a surface. The device comprises a material container and a surface applicator for applying the applicator material to the surface. A valve having a valve element is interposed between the material container and the surface applicator to permit the flow of applicator material to the surface applicator when the valve element is in an open position and to inhibit the flow of applicator material to the surface applicator when the valve element is in a closed position. The valve includes a valve closure having an internal closure cavity with a first end being connected to the material container and with a second end defining a surface applicator opening therein. The valve element has a distal end portion which extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. The applicator device is suitable for applying liquids such as typewriter correction fluids, oils, paints and coatings as well as semi-solids or solids such as glues, gels and powders.

11 Claims, 13 Drawing Figures

APPLICATOR DEVICE

BACKGROUND OF THE INVENTION

1. Field of the Invention

This invention relates to the dispensing of liquids and flowable solids and more particularly, this invention relates to an improved applicator device for applying, marking or dispersing a liquid or a flowable solid to a surface.

2. Description of the Prior Art

Various types of marking devices have been devised for marking or writing with ink, dye or paint. Among such devices are fountain pens, ball point pens, felt tip pens, capillary tube pens, fiber tip pens and the like. In addition, various other applicator devices have been devised in the prior art for applying and/or the dispersing a wide variety of other types of products in the form of a liquid, a semi-solid or a flowable solid such as glues, insect repellants, oils and greases, and lubricants such as graphite and the like.

The writing, marking and applicator devices of the prior art have received wide acceptance due in great measure to the convenience of the device and the ability to retain a large quantity of material in a material container. Further, the writing and applicator devices of the prior art have received wide acceptance due to the ability to supply additional applicator material from a material container to a surface applicator at the discretion of the user.

Continuing efforts have been made in the past to improve the design of applicator devices, particularly in the mechanism delivering the applicator material from the material container to the surface applicator for writing, marking or otherwise applying the applicator material on a surface. In a typical prior art applicator device, the applicator material flows to the surface applicator only when the applicator device is held upside down allowing the applicator material to flow to the surface applicator by action of gravity. In other prior art applicator devices, the applicator device incorporated a valve allowing the applicator material to flow to an applicator tip only when the applicator device is held upside down simultaneously with the opening of the valve for allowing the applicator material to flow to the applicator tip by action of gravity. In still other prior art applicator devices, the applicator material flows to an applicator tip only when the applicator device is held upside down simultaneously with a reduction in the volume of the material container to force the applicator material to flow to the applicator tip.

Prior to the advent of the present invention, there have been various problems in the design, fabrication, assembly and the utilization of applicator devices of the prior art. Most prior art devices incorporating a valve have required an excessively large number of parts. In general, the prior art applicator devices incorporating a valve had to be filled with the applicator material and then held in an upright orientation during the process of assembling the remainder of the applicator device. Accordingly, the completed but unassembled component parts of the material applicator device had to be shipped from a component parts of the manufacturer to a filling plant whereat the component parts had to be assembled concurently with the filling of the containers. In general, the filling plants desire to undertake only the final assembly of a product as opposed to undertaking the entire assembly as required by the prior art applicator devices. This necessarily increased not only the total manufacturing cost, but also required the filling plant to provide an additional assembly line as well as to provide the quality control for the applicator device mechanism.

Accordingly, writing, marking and applicator devices of the prior art did not permit the assembly of the applicator mechanism independent of the material container which could be preassembled and shipped for final assembly at a filling plant while maintaining a low cost for the material applicator device. As a result of these and various other factors, the unit price for material applicator devices has been unnecessarily high.

It should be readily appreciated that the fabrication of the valve mechanism of an applicator device independent of the material container is a significant advancement in the art. The applicator device of the present invention allows for the fabrication, assembly and shipment of the applicator device mechanism from a single manufacturing site. Thereafter, the applicator device mechanism may be shipped to a filling plant whereat the material containers may be filled with an applicator material. The applicator device mechanisms may then be sealed to the filled material containers. Furthermore, the improved applicator device of the present invention permits a user to separate the applicator device mechanism from a depleted material container without disassembling the applicator device mechanism. Consequently, the applicator device of the present invention could be refilled by the user to thereby extend the utility of applicator device and to further reduce the overall cost of the use of the applicator device.

Therefore, it is an object of the present invention to provide an improved applicator device for dispensing an applicator material wherein the applicator device mechanism may be constructed independently of the material container and subsequently coupled to the filled material container to form the completed applicator device.

Another object of the present invention is to provide an improved applicator device for dispensing an applicator material having an increased ease of assembly herein unknown in the prior art.

Another object of the present invention is to provide an improved applicator device for dispensing an applicator material which is more economical than the prior art applicator devices through the incorporation of component parts which permit the applicator device mechanism to be assembled by an assembly machine independent of the material container.

Another object of the present invention is to provide an improved applicator device for dispensing an applicator material which permits a user to separate the applicator device mechanism from a depleted material container without disassembling the applicator device mechanism for enabling the applicator device to be refilled by the user.

Another object of the present invention is to provide an improved applicator device for dispensing liquids such as inks, dyes, paints or chemicals in addition to dispensing a wide variety of other types of products in the form semi-solids or flowable solids such as glues, insect repellants, oils and greases, and lubricants such as graphite and the like.

Another object of the prsent invention is to provide an improved applicator device for dispensing an applicator material incorporating a surface applicator which permits a user to disperse the dispensed material on the surface.

Another object of the present invention is to provide an improved applicator device for dispensing an applicator material incorporating a valve for sealing the applicator device to prevent evaporation of the material in the material container.

Another object of the present invention is to provide an improved applicator device for dispensing an applicator material incorporating a valve that is moveable into an open position upon a user depressing a surface applicator on a surface.

Another object of the present invention is to provide an improved applicator device for dispensing an applicator material incorporating a material container, a valve closure, a valve body, a valve element and bias means for providing the sealing of the container as well as providing the dispensing and the dispersion of the material on the surface upon depression of the valve element upon a surface.

Another object of the present invention is to provide an improved applicator device for dispensing an applicator material which is convenient to use for painting, marking, or applying a typewriter correction liquid to a typed document.

The foregoing has outlined some of the more pertinent objects and advantages of the present invention. These objects and advantages should be construed to be merely illustrative of some of the more pertinent features and applications of the intended invention. Many other beneficial results can be obtained by applying the disclosed invention in a different manner or modifying the invention within the spirit and scope of the disclosure. Accordingly, other objects and advantages and a fuller understanding of the invention may be had by referring to the summary of the invention and the detailed description describing the preferred embodiments in addition to the scope of the invention defined by the claims taken in conjunction with the accompanying drawings.

SUMMARY OF THE INVENTION

The present invention is defined by the appended claims with the specific embodiments shown in the attached drawings. For the purpose of summarizing the invention, the invention may be incorporated into an improved applicator device for applying an applicator material to a surface comprising container means for containing the applicator material and a surface applicator for applying the applicator material to the surface. A valve is interposed between the container means and the surface applicator with the valve having a valve element being movable between an open position and a closed position. The valve permits the flow of applicator material from the container means to the surface applicator when the valve element is in the open position and inhibits the flow of applicator material from the container means to the surface applicator when the valve element is in the closed position. The valve comprises a valve closure having a first and a second end with the valve defining an internal closure cavity therein. Means connect the first end of the valve closure to be in communication with the container means. The second end of the valve closure defines an applicator opening being in communication with the internal closure cavity. The valve element has a distal end portion extending through the applicator opening of the valve closure when the valve element is in the closed position. Bias means is provided for biasing the valve element into the closed position. The surface applicator comprises the distal end portion of the valve element being movable relative to the applicator opening against the bias means upon the distal end portion of the valve element being pressed against the surface thereby moving the valve element from the closed position to the open position to enable the flow of the applicator material through the applicator opening to apply the applicator material to the surface.

In one specific embodiment of the invention, the container means is substantially rigid whereas in another specific embodiment of the invention the container means includes means for reducing the volume of the container means to force the applicator material from the container means through the applicator opening to the surface when the valve element is in the open position. The means for reducing the volume of the container means may include the container means having a resilient or flexible container wall.

Preferably, the internal closure cavity of the valve closure defines a valve closure surface between the first and second ends of the valve closure for cooperation with an outer valve element surface to provide a seal therebetween when the valve element is in the closed position. The internal closure cavity of the valve closure may be tapered between the first end and the second end to define the valve closure surface of the valve closure. The second end of the valve closure defines an annular opening when the valve element is in the open position. The first end of the valve closure may be connected to the container means through a friction or press fit with an open end of the container or may be connected to the container means through interlocking threads formed in the open end of the container. The distal end of the valve element provides means for dispersing the applicator material on the surface. In one specific embodiment of the invention, the second end of the valve closure has a substantially reduced cross-sectional area relative to the first end of the valve closure for providing a reduced cross-sectional area to disperse the applicator material on the surface.

The valve comprises a valve body at least partially disposed in the internal closure cavity of the valve closure with the bias means coacting between the valve body and the valve element. The valve body includes a valve body base and valve body sidewall means for securing the valve body to the valve closure. In one embodiment of the invention, projection means in one of the valve body and the valve closure engage recess means in the other of the valve body and the valve closure means for securing the valve body to the valve closure. The valve body includes valve body aperture means for enabling the flow of the applicator material from the container means to the internal closure cavity of the valve closure. The bias means may include a coil spring coacting between the valve element and the valve body base of the valve body or may include an integral plastic spring coacting between the valve element and the valve body base of the valve body.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature, objects and advantages of the invention, reference should be made to the following detailed description taken in connection with the accompanying drawings in which.

Similar reference numerals refer to similar parts throughout the several views of the drawings.

DETAILED DISCUSSION

Figure 1:
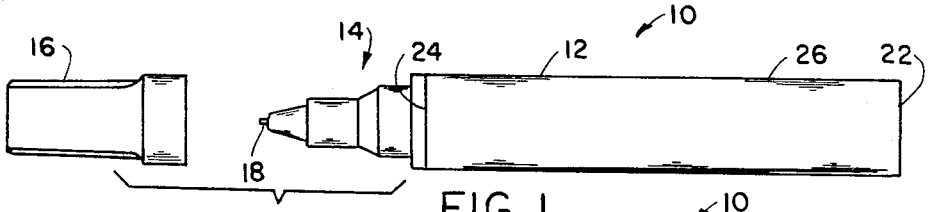
FIG. 1 is a side elevational view of a first embodiment of an applicator device of the present invention.

FIG. 1 is an elevational view of a first embodiment of the present invention illustrating a material applicator device 10 comprising a material container 12, an applicator mechanism 14 and an overcap 16. The applicator mechanism 14 includes a surface applicator 18 for applying an applicator material to a surface (not shown) upon the depression of the surface applicator 18 against the surface.

Figure 2:
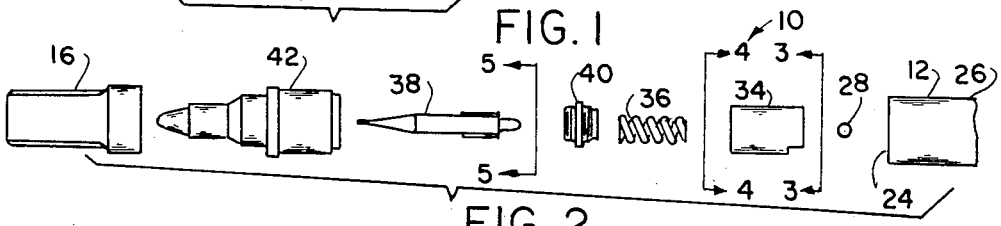
FIG. 2 is an exploded view illustrating the first embodiment of the applicator device shown in FIG. 1.

FIG. 2 is an exploded view of a first embodiment of the present invention shown in FIG. 1. The material container 12 is preferably constructed of a metallic or plastic substance and is provided with a closed end 22, an open end 24 and cylindrical side walls 26. The open end 24 is adapted to receive and store a quantity of applicator material. When the applicator device 10 is used to apply a marking liquid, the marking liquid may be formed of opaque particles suspended in a carrier liquid. The applicator device 10 may include agitator means 28 shown as a single ball but a plurality of balls or a metal slug may be disposed within the material container 12. Preferably, the agitator means 28 is formed of a metallic substance having a specific gravity significantly greater than the carrier liquid and with the metallic material being selected to minimize any chemical reaction with the carrier liquid. The agitator means 28 disburses the suspended opaque particles within the carrier liquid in the event that the suspended opaque particles have become precipitated or settled from the carrier liquid.

The applicator mechanism 14 includes a valve body 34, bias means shown as a spring 36, a valve element 38, a valve guide 40 and a valve closure 42. The valve body 34, the valve element 38, the valve guide 40 and the valve closure 42 are preferably formed of a plastic material such as polypropylene or another similar moldable material having a relatively rigid but slightly yieldable characteristic. The bias means is shown in this embodiment as a compression coil spring 36 which is preferably formed of stainless steel or another suitable material to preclude or minimize chemical reaction with the applicator material. Although the bias means has been shown as a compression coil spring 36 in the drawings, it should be understood that various other bias means may be used such as an integral plastic spring as disclosed in U.S. Pat. No. 4,471,893.

Figure 3:
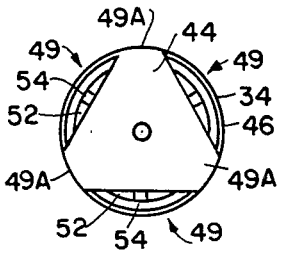
FIG. 3 is an enlarged partial view along line 3—3 in FIG. 2.
Figure 4:
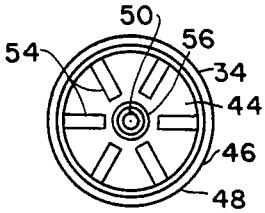
FIG. 4 is an enlarged partial view along line 4—4 in FIG. 2.
Figure 6:
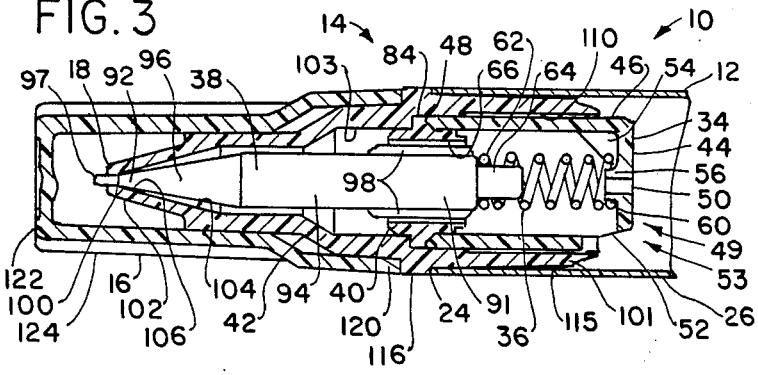
FIG. 6 is an enlarged sectional view of the applicator device of FIG. 1 in a closed position.
Figure 7:
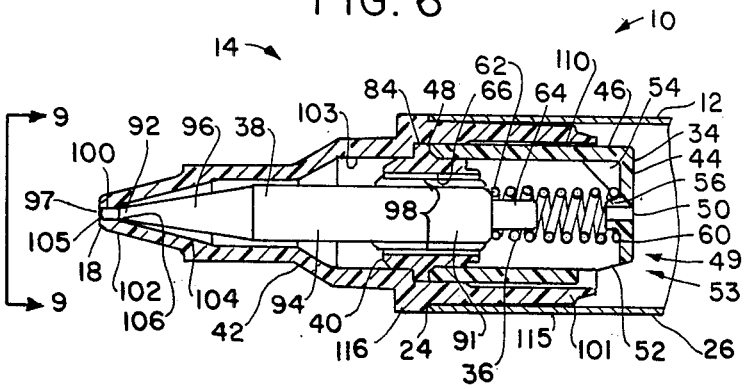
FIG. 7 is an enlarged sectional view of the applicator device of FIG. 1 in an open position.

As shown in greater detail in FIGS. 3, 4, 6 and 7, the valve body 34 is a cup-shaped configuration having a bottom face 44, cylindrical side walls 46 and an enlarged annular open top having a shoulder 48. The bottom face 44 of the valve body 34 is of a generally triangular shape defining voids 49 between the apices 49A of the triangle as shown in FIG. 3. In order to allow essentially unrestricted flow of the applicator material from the material container 12 into the valve body 34, the valve body 34 is provided with aperture means shown in this embodiment as a plurality of material passing apertures including an axial hole 50 and a plurality of slots 52. The hole 50 is disposed in the bottom face 44 whereas the plurality of slots 52 are formed transversely in the peripheral sidewalls 46 of the valve body 34. The slots 52 are located adjacent the voids 49 to form large flow openings 53 between the inside surface of the material container 12 and the valve body 34 to facilitate the flow of the applicator material therebetween. A plurality of spring orientating ribs 54 are formed in the valve body 34 and extend between an inside surface of the cylindrical sidewalls 46 and an inside surface of the bottom face 44 as shown in FIGS. 4, 6 and 7. The orientation ribs 54 enable the positioning of the coil spring 36 on a projection 56 extending from the bottom face 44 of the valve body 34. The projection 56 surrounds the axial hole 50 and engages the inner diameter of an inner spring end 60 of the coil spring 36. The inner diameter of an outer spring end 62 of the coil spring 36 is adapted to engage a projection 64 extending from the valve element 38.

The valve guide 40 is generally cylindrically shaped having an internal bore 66 and is provided with a circumferential shoulder 84 having a diameter greater than the remainder of the valve guide 40. The shoulder 84 is substantially the same diameter as the diameter of the annular shoulder 48 of the valve body 34 enabling the valve guide 40 to be inserted into the valve body 34 as shown in FIGS. 6 and 7. The shoulder 84 of the valve guide 40 engages the annular shoulder 48 of the valve body to limit the depth of insertion of the valve guide 40 into the valve body 34. As shown in greater detail in FIG. 8, an annular projection 88 extends from the valve guide 40 whereas an annular recess 90 is located in the valve body 34. The annular projection 88 is received within the annular recess 90 in an interlocking engagement to couple the valve guide 40 to the valve body 34.

Figure 5:
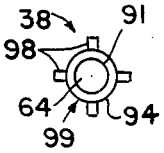
FIG. 5 is an enlarged partial view along line 5—5 in FIG. 2.

The valve element 38 has a first end 91 and a second end 92 and defines a generally cylindrically shaped region 94, a generally conically shaped region 96 and a distal end 97. The projection 64 is preferably integrally formed on the first end 91 of the valve element 38. A plurality of guide ribs 98 shown in FIG. 5 extend from the generally cylindrically shaped region 94 of the valve element 38 for cooperation with the internal bore 66 of the valve guide 40 to properly center the valve element 38 within the valve guide 40. Voids 99 defined between the guide ribs 98 provide spaces to enable the flow of the applicator material therethrough. The generally conically shaped region 96 interconnects the cylindrically shaped region 94 and a distal end 97 and defines a valve element sealing surface 100.

The valve closure 42 has a first end 101 and a second end 102 with an internal closure cavity 103 extending therebetween. The internal closure cavity 103 has a tapered region 104 which terminates in an applicator opening 105. The tapered region 104 defines a valve closure sealing surface 106 adjacent the applicator opening 105. The valve closure sealing surface 106 of the valve closure 42 cooperates with the valve element sealing surface 100 of the valve element 38 to form a valve for regulating the flow of the applicator material from the material container 12. In addition, the applicator opening 105 of the valve closure 42 cooperates with the distal end 97 of the valve element 38 for actuating the valve element 38 and for forming the surface applicator 18 to apply and disperse the applicator material to the surface as will be explained in greater detail hereinafter.

Figure 8:
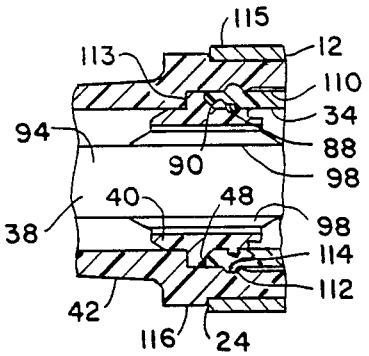
FIG. 8 is an enlarged partial view of FIG. 6 illustrating the interlocking of a valve closure and a valve body.
Figure 9:
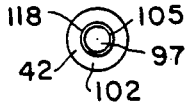
FIG. 9 is an enlarged partial view along line 9—9 of FIG. 7.

The internal closure cavity 103 of the valve closure 42 has an inner diameter region 110 for receiving the shoulder 84 of the valve guide 40 and the annular shoulder 48 of the valve body 34. As best shown in FIG. 8, the valve closure 42 is provided with a circumferential inner recess 112 capable of receiving and positively retaining an annular projection 114 extending from the valve body 34. In the assembled configuration shoulder 84 of the valve guide 40 engages with a shoulder 113 of the valve closure 42.

The valve element 38 is movable between a closed position as shown in FIG. 6 and an open position as shown in FIG. 7 with the coil spring 36 biasing the valve element 38 into the closed position. In the closed position, the coil spring 36 causes the valve element sealing surface 100 to engage with the valve closure sealing surface 106 to inhibit the flow of applicator material from the material container 12 to the surface applicator 18. The distal end 97 of the valve element 38 extends beyond the second end 102 of the valve closure 42 when the valve element 38 is in the closed position as shown in FIG. 6. The distal end 97 of the valve element 38 permits a user to actuate the valve element 38 into the open position as shown in FIG. 7 when the distal end 97 is pressed against a surface. When the valve element 38 is in the open position, the distal end 97 and the applicator opening 105 form an annular opening 118 as shown in greater detail in FIG. 9. When the valve element 38 is in the open position, the applicator material is permitted to flow from the material container 12 through the valve body 34 and the internal closure cavity 103 to the surface applicator 18. When the depressing pressure is removed from the distal end 97, the valve element 38 returns to the closed position shown in FIG. 6 to inhibit the flow of the applicator material to the surface applicator 18. The applicator device 10 shown in FIGS. 1–9 illustrates the flow of the applicator material by action of gravity. However, it should be understood that the present invention is suitable for use with applicator material flowing under pressure as will be described in greater detail hereinafter.

The applicator mechanism 14 is joined to the material container 12 in the embodiment by a press fit engagement. The exterior diameter 115 of the valve closure 42 is tapered to be inserted into the open end 24 of the material container 12. The exterior surface of the closure 42 is provided with a shoulder 116 for engaging the open end 24 of the material container 12 to axially limit the movement of the applicator mechanism 14 relative to the material container 12 during the fabrication process.

The overcap 16 includes an inner end 120 having a diameter selected for a friction fit with the valve closure 42. The shoulder 116 of the valve closure 42 limits the movement of the overcap 16 on the valve closure 42. The overcap 16 has a closed outer end 122 positioned to avoid contact with the surface applicator 18 when the overcap 16 is positioned on the valve closure 42 as shown in FIG. 6. The overcap 16 may be provided with external gripping ribs 124 for aiding in the removal of the overcap 16 by a user. The valve closure 42 and the overcap 16 are preferably formed of acetal or a similar moldable material which will inhibit evaporation of any carrier liquid or solvent within the applicator material.

The first embodiment of the applicator devices 14 may be fabricated entirely by automated machinery. First, the inner end 60 of the coil spring 36 is frictionally attached to the projection 56 of the valve body 34. Second, the valve guide 40 is pressed into the open end of the valve body 34 with the shoulder 84 of the valve guide 40 engaging the shoulder 48 of the valve body 34 and with the recess 90 of the valve body 34 receiving the projection 88 of the valve guide 40 as best shown in FIG. 8. Third, the valve element 38 is inserted into the internal bore 66 of the valve guide 40 with the projection 64 of the valve element 38 frictionally receiving the outer end 62 of the coil spring 36. Fourth, the valve closure 42 is coupled to the valve body 34 with the annular recess 112 of the valve closure 42 receiving the annular projection 114 of the valve body 34 and with shoulder 113 engaging shoulder 48. Optionally, the overcap 16 may be frictionally secured to the valve closure 42 as heretofore described to complete the applicator mechanism 14. The completed applicator mechanism 14 then may be shipped to a filling plant wherein the applicator material is placed within the material container 12 and the application mechanism 14 is secured to the material container 12. Preferably, the exterior diameter 115 of the valve closure 42 is press fit into the open end 24 of the material container 12 as shown in FIGS. 6 and 7.

The operation of the invention set forth in FIGS. 1–9 should be apparent from the forgoing description. Initially, the overcap 16 is removed to expose the distal end 97 of the valve element 38. The distal end 97 of the valve element 38 is then pressed against a surface by a user for applying the applicator material on the surface.

The distal end 97 of the valve element 38 also functions as a means for dispersing the applicator material on the surface. When the user determines that the supply of applicator material flowing to the surface applicator 18 has become insufficient, the user can supply additional applicator material to the surface applicator 18 by holding the surface applicator 18 downwardly relative to the material container 12 and depressing the distal end 97 of the valve element 38 against the surface. Movement of the distal end 97 moves the valve element 38 against the bias of the spring 36 to separate the valve element sealing surface 100 from the valve closure sealing surface 106 of the valve closure 42 as shown in FIG. 6. The applicator material is permitted to flow from the material container 12 through the valve body 34 to the surface applicator 18. The release of the depressing pressure from the distal end 97 causes the spring 36 to return the valve element 38 to the closed position as shown in FIG. 7 to inhibit the flow of the applicator material from the material container 12 to the surface applicator 18.

Figure 10:
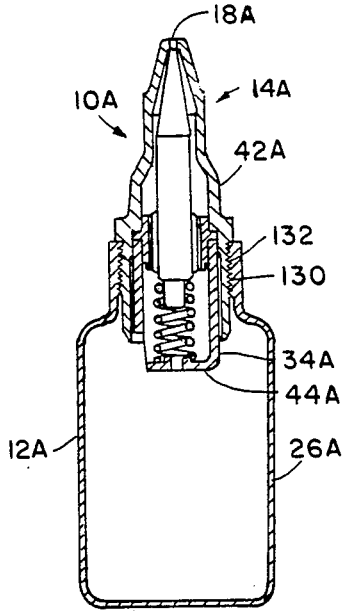
FIG. 10 is a sectional view of a second embodiment of the present invention illustrating a flexible wall container.

FIG. 10 is a sectional view of a second embodiment of the present invention illustrating a material applicator device 10A comprising a material container 12A, an applicator mechanism 14A and an overcap 16 (not shown). The applicator mechanism 14A includes a surface applicator 18A for applying an applicator material to a surface (not shown) upon the depression of the surface applicator 18A against the surface. The structure and the function of the applicator mechanism 14A is identical to the applicator mechanism 14 shown in FIGS. 1–9 except as noted herein.

In this embodiment, the valve closure 42A also comprises threads 130 for engaging with threads 132 on the material container 12A. The use of a threaded engagement between the valve closure 42A and the container 12A enables the user to unscrew applicator mechanism 14A from the material container 12A and to refill the material container 12A with the applicator material. When the applicator material in the material container 12A has been depleted, the applicator mechanism 14A may be unscrewed and separated from the material container 12A and refilled with applicator material. The applicator mechanism 14A may be then reassembled with the material container 14A for further use. During the refilling process, the components of the applicator mechanism 14A remain in an interlocked combination in contrast to the prior art devices. It should be appreciated by those skilled in the art that various other means may be incorporated for securing the applicator mechanism 14A to the material container 12A.

The applicator device 10A also includes a flexible wall container 12A which is preferably a flexible plastic container enabling the user to reduce the internal volume of the container 12A by squeezing or otherwise flexing the container sidewall 26A. The applicator mechanism 14A in combination with the flexible wall container 12A allows the user to dispense the applicator material under pressure. The dispensing of the applicator material under pressure enables the dispensing of viscous liquids and/or semi-solids such as glues, gels and other viscous materials. Although the means of dispensing the applicator material under pressure has been shown as a flexible wall material container 12A, it should be understood that various other means may be used to reduce the internal volume of the material container.

Figure 11:
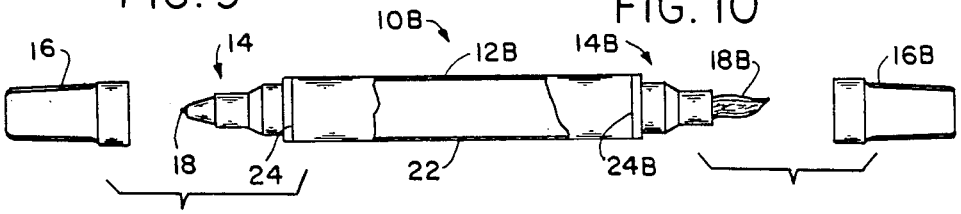
FIG. 11 is a side elevational view partially in section of a third embodiment of the present invention illustrating an applicator device having plural surface applicators for a single applicator material.

FIG. 11 is a side elevational view partially in section of a third embodiment of the present invention illustrating an applicator device 10B having a first surface applicator 18 on one end 24 of a material container 12B and a second surface applicator 18B on a second end 24B of the material container 18B. In this embodiment, the first applicator mechanism 14 and the first surface applicator 18 are identical to the first embodiment shown in FIGS. 1–9 whereas the second applicator mechanism 14B and the second surface applicator 18B utilize a brush applicator device. In this embodiment, the material container 12B contains a common applicator material for dispensing through each of the first and second surface applicators 18 and 18B.

Figure 12:
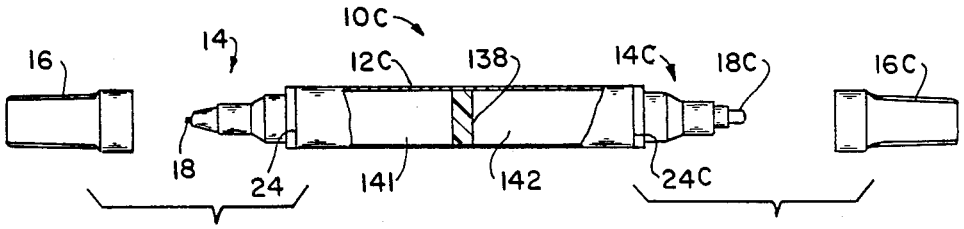
FIG. 12 is a side elevational view partially in section of a fourth embodiment of the present invention illustrating an applicator device having plural surface applicators for plural applicator materials.

FIG. 12 is a side elevational view partially in section of a fourth embodiment of the present invention illustrating an applicator device 10C having a first surface applicator 18 on one end 24 of a material container 12C and a second surface applicator 18C on a second end 24C of the material container 18C. In this embodiment, the first applicator mechanism 14 and the first surface applicator 18 are identical to the first embodiment shown in FIGS. 1–9 whereas the second applicator mechanism 14C and the second surface applicator 18C utilize a fiber tip applicator device. In this embodiment, the material container 12C contains an intermediate wall 138 to separate the material container 12C into a first and a second container portion 141 and 142 to respectively receive a first and a second applicator material for dispensing through the first and second surface applicators 18 and 18C, respectively. The intermediate wall 138 may be inserted into a tubular container such as the container 12B or may be integrally formed with the container 12C.

Figure 13:
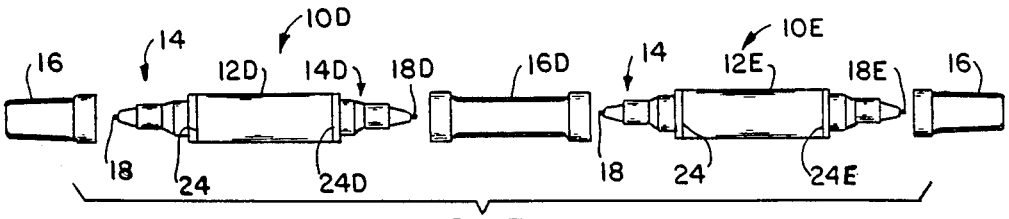
FIG. 13 is a side elevational view of a fifth embodiment of the present invention illustrating plural applicator devices each having plural surface applicators.

FIG. 13 is a side elevational view of a fifth embodiment of the present invention illustrating a first and a second applicator device 10D and 10E. The first applicator device 10D has a first surface applicator 18 on one end 24 of a material container 12D and a second surface applicator 18D on a second end 24D of the material container 12D. The second applicator device 10E has a first surface applicator 18 on one end 24 of a material container 12E and a second surface applicator 18E on a second end 24E of the material container 12E. In this embodiment, the first applicator mechanisms 14 and the first surface applicators 18 of the first and the second applicator devices 10D and 10E are identical to the first embodiment shown in FIGS. 1–9. In addition, the second applicator mechanisms 14D and 14E and the second surface applicators 18D and 18E of the first and the second applicator devices 10D and 10E are shown to be identical to the first embodiment shown in FIGS. 1–9. However, various combinations of surface applicators and intermediate walls may be incorporated and/or combined to modify the invention within the scope of the present invention as should be well known to those skilled in the art. A combined overcap and coupling device 16D functions as an overcap as heretofore described as well as coupling the first and second applicator devices 10D and 10E into a single unit for ease of transportation.

The applicator devices set forth herein may readily be used for writing, marking or applying a large variety of liquids in a manner similar to conventional writing or marking devices. In addition, the applicator devices set forth herein may readily be used for applying and/or dispersing a large variety of other liquids, semi-solids or flowable solids. The applicator device also permits a user to separate the applicator device mechanism from a depleted material container without disassembling the applicator device mechanism for enabling the applicator device to be refilled by the user. The applicator device provides a superior seal to inhibit evaporation of any carrier liquids as well as preventing leakage or accidental spillage of the applicator material. Furthermore, the applicator device may be used to apply and disperse semi-solids such as very viscous liquids or gels and may be used to apply and disperse flowable solids such as powders. The use of the flexible wall container shown in FIG. 10 or the equivalent thereof provides convenient means for applying semi-solids and flowable solids. The surface applicator of the present invention provides remarkable control of the amount of the applicator material applied to the surface while the distal end provides means for dispersing or otherwise spreading the applicator material on the surface.

The present disclosure includes that contained in the appended claims as well as that of the foregoing description. Although this invention has been described in its preferred forms or embodiments and methods with a certain degree of particularity, it is understood that the present disclosure of the preferred form has been made only by way of example and that numerous changes in the details of construction fabrication and use and including the combination and arrangement of parts and steps may be resorted to without departing from the spirit and scope of the invention.

What is claimed is:

1. An improved applicator device for applying an applicator material to a surface, comprising in combination:

container means for containing the applicator material;

a valve comprising a valve closure having a first and a second end and defining an internal closure cavity therein;

said valve including a valve body having a generally cylindrical side wall and a bottom face with valve body aperture means extending through said bottom face;

said valve including a valve guide having an internal bore;

said valve including a valve element having a proximal end and a distal end with said distal end defining a surface applicator for applying the applicator material to the surface;

said valve element having a plurality of guide ribs extending from an outer surface of said valve element for slidably engaging with said internal bore of said valve guide;

said plurality of guide ribs of said valve element defining a plurality of voids therebetween for enabling the flow of the applicator material through said plurality of voids;

said second end of said valve closure defining a valve seal and an applicator opening;

means connecting said valve closure to said valve body with said valve guide interposed therebetween and with said valve element being disposed in said internal closure cavity of said valve closure and slidably extending through said internal bore of said valve guide and with said surface applicator of said valve element extending through said applicator opening of said valve closure;

means connecting said first end of said valve closure to said container means for enabling the flow of the applicator material from said container means through said valve body aperture means;

bias means coacting between said bottom face of said valve body and said proximal end of said valve element for biasing said distal end of said valve element into sealing engagement with said valve seal of said valve closure for inhibiting the flow of applicator material through said applicator opening; and said surface applicator being movable relative to said applicator opening against said bias means upon said surface applicator of said valve element being pressed against the surface thereby moving said valve element out of sealing engagement with said valve seat of said valve closure to enable the flow of the applicator material through an annular opening between said applicator opening of said valve closure and said distal end of said valve element to apply the applicator material to the surface.

2. An improved applicator device as set forth in claim 1, wherein said container means is substantially rigid.

3. An improved applicator device as set forth in claim 1, wherein said container means includes means for reducing the volume of said container means to force the applicator material from said container means through said applicator opening to the surface when said valve element is in an open position.

4. An improved applicator device as set forth in claim 3, wherein said means for reducing the volume of said container means includes said container means having a resilient flexible container wall.

5. An improved applicator device as set forth in claim 1, wherein said means connecting said first end of said valve closure to said container means includes said valve closure being press fitted into an open end of said container means.

6. An improved applicator device as set forth in claim 1, wherein said means for connecting said first end of said valve closure to said container means includes thread means.

7. An improved applicator device as set forth in claim 1, wherein said distal end of said valve element provides means for dispersing the applicator material on the surface.

8. An improved applicator device as set forth in claim 1, wherein said means for securing said valve body to said valve closure includes projection means in one of said valve body and said valve closure engaging recess means in the other of said valve body and said valve closure.

9. An improved applicator device as set forth in claim 1, wherein said bias means includes a spring coacting between said valve element and said valve body base of said valve body.

10. An improved applicator device as set forth in claim 1, wherein said second end of said valve closure has a substantially reduced cross-sectional area relative to said first end of said valve closure for providing a reduced cross-sectional area to disperse the applicator material on the surface.

11. An improve applicator device as set forth in claim 1, wherein said means connecting said valve closure to said valve body with said valve guide interposed therebetween includes projection means in one of said valve body and said valve closure for engaging with recess means in the other of said valve body and said valve closure for securing said valve body to said valve closure in a snap interlocking engagement.

* * * * *